US006644156B2

(12) United States Patent
Villacis

(10) Patent No.: US 6,644,156 B2
(45) Date of Patent: Nov. 11, 2003

(54) FABRIC GOODS CUTTING TABLE WITH LASER ALIGNMENT

(75) Inventor: Richard S. Villacis, Miami, FL (US)

(73) Assignee: L&P Property Management Company, South Gate, CA (US)

( * ) Notice: Subject to any disclaimer, the term of this patent is extended or adjusted under 35 U.S.C. 154(b) by 3 days.

(21) Appl. No.: 10/046,855

(22) Filed: Jan. 15, 2002

(65) Prior Publication Data

US 2003/0131704 A1 Jul. 17, 2003

(51) Int. Cl.[7] ..... B26D 5/00
(52) U.S. Cl. ..... 83/425; 83/522.11
(58) Field of Search ..... 83/520, 522.11, 83/522.12–522.29, 508.3, 425.4

(56) References Cited

U.S. PATENT DOCUMENTS

| | | | | | |
|---|---|---|---|---|---|
| 3,628,253 | A | | 12/1971 | Shepard | |
| 3,958,477 | A | | 5/1976 | Carlson | |
| 4,161,974 | A | * | 7/1979 | Patterson | 144/287 |
| 4,583,181 | A | * | 4/1986 | Gerber et al. | 700/143 |
| 4,676,130 | A | * | 6/1987 | Nutt | 83/155 |
| 4,683,658 | A | * | 8/1987 | Stumpf | 30/275 |
| 4,701,018 | A | | 10/1987 | Loucks | |
| 4,715,238 | A | * | 12/1987 | Bernardi | 74/6 |
| 4,885,967 | A | * | 12/1989 | Bell et al. | 83/520 |
| 4,907,323 | A | * | 3/1990 | Smith et al. | 29/2.21 |
| 5,132,510 | A | * | 7/1992 | Klingel et al. | 219/121.82 |
| 5,259,495 | A | * | 11/1993 | Douglas | 198/404 |
| 5,322,001 | A | | 6/1994 | Boda | |
| 5,446,635 | A | | 8/1995 | Jehn | |
| 5,488,781 | A | | 2/1996 | Van Der Horst | |
| 5,675,899 | A | | 10/1997 | Webb | |
| 5,960,554 | A | * | 10/1999 | Kamykowski | 33/562 |
| 6,003,217 | A | * | 12/1999 | Graves et al. | 29/24.5 |
| 6,050,168 | A | | 4/2000 | Kuchta et al. | |
| 6,073,621 | A | * | 6/2000 | Cetrangolo | 125/12 |

* cited by examiner

*Primary Examiner*—Allan N. Shoap
*Assistant Examiner*—Ghassem Alie
(74) *Attorney, Agent, or Firm*—Wood, Herron & Evans, L.L.P.

(57) ABSTRACT

A cutting table for cutting pieces of fabric. The table has a fabric supporting surface mounted on a frame. A cutter is manually movable along a linear cutting path that is substantially perpendicular to an edge guide. First and second light emitting devices emit respective first and second lights in a direction substantially parallel to the linear cutting path. A manually powered drive supports the first and second light emitting devices in a spaced apart relationship, and the drive is manually operable to move the light emitting devices through equal displacements in opposite directions substantially perpendicular to the linear cutting path. The light emitting devices are used to quickly align the fabric, so that it can be cut to a desired width.

18 Claims, 6 Drawing Sheets

FABRIC GOODS CUTTING TABLE WITH LASER ALIGNMENT

FIELD OF THE INVENTION

This invention relates generally to a cutting table and, more particularly, to a cutting table for cutting fabric goods, materials or stock.

BACKGROUND OF THE INVENTION

The cutting of fabric or material for the manufacture of bedding and furniture can be done by hand or by a fully automated machine. Both have their advantages and disadvantages. For example, fully automated machines are accurate, reliable and require minimal labor; however, fully automated machines are expensive and often cannot be sold in price sensitive markets. Further, fully automated machines require substantial selvage on the fabric in order to reliably automatically cut the fabric to size. Hence, the fabric is used less efficiently than if it were manually cut in a manufacturing process. Thus manual cutting often provides some benefits and efficiency with respect to material usage; however, it is difficult and time consuming for an operator to manipulate and cut larger fabric pieces such as those used in bedding. Therefore, known methods of manually cutting of the material are also expensive.

Consequently, there is a need for cutting table that facilitates a manual fabric cutting process, so that material of a desired size can be efficiently and quickly cut.

SUMMARY OF THE INVENTION

The present invention provides a cutting table that permits fabric to be easily and quickly manually aligned so that the fabric can be accurately cut with parallel edges. Such a cutting table provides a significant advantage in servicing those markets where fully automated machines are price prohibitive. The cutting table of the present invention also permits the fabric to be quickly and accurately manually aligned with an existing pattern in the material. Hence the cutting table has a further advantage of having more flexibility. The cutting table of the present invention also permits fabric with minimal selvage to be trimmed and used in production. Material with minimal selvage would otherwise be scrapped; and therefore, the cutting table of the present invention has a still further advantage of a more efficient use of the fabric.

According to the principles of the present invention and in accordance with the described embodiments, the invention provides a cutting table for cutting pieces of fabric. The table has a fabric supporting table surface mounted on a frame. A cutter is manually movable along a linear cutting path that is substantially perpendicular to an edge guide. First and second light emitting devices emit respective first and second lights in a direction substantially parallel to the linear cutting path. A manually powered drive supports the first and second light emitting devices in a spaced apart relationship, and the drive is manually operable to move the light emitting devices through equal displacements in opposite directions substantially perpendicular to the linear cutting path. The light emitting devices are used to quickly align the fabric, so that it can be cut to a desired width.

In one aspect of this invention, a carriage mounted on the frame supports the manually powered drive, and the carriage is manually movable in a direction substantially perpendicular to the cutting path. Further, the manually powered drive has first and second racks supporting the respective first and second light emitting devices. The first rack engages one side of a pinion and the second rack engaging an opposite side of the pinion. A handwheel is connected to the pinion, and rotation of the handwheel moves the racks through equal displacements in opposite directions.

In another embodiment of the invention, a method is provided for cutting a piece of fabric. First, the fabric is manually placed on a table surface to locate a first edge against an edge guide and a second, adjacent edge across a linear cutting path substantially perpendicular to the edge guide. First and second light emitting devices are moved to a location where respective first and second lights are substantially equidistant from a desired center line of the fabric. A cutter is then manually moved along the linear cutting path identified by the first light to cut a second edge of the fabric substantially perpendicular to the one edge. The fabric is manually moved on the table surface to locate a third edge, opposite the first edge, against the edge guide, and the second edge of the fabric in line with the second light. The cutter is again manually moved along the linear cutting path to cut a fourth edge of the fabric that is substantially parallel to the second edge. The distance between the second and fourth edges being substantially equal to the desired dimension, for example, width, of the fabric.

These and other objects and advantages of the present in will become more readily apparent during the following detailed description taken in conjunction with the drawings herein.

DETAILED DESCRIPTION OF THE INVENTION

Figure 1:
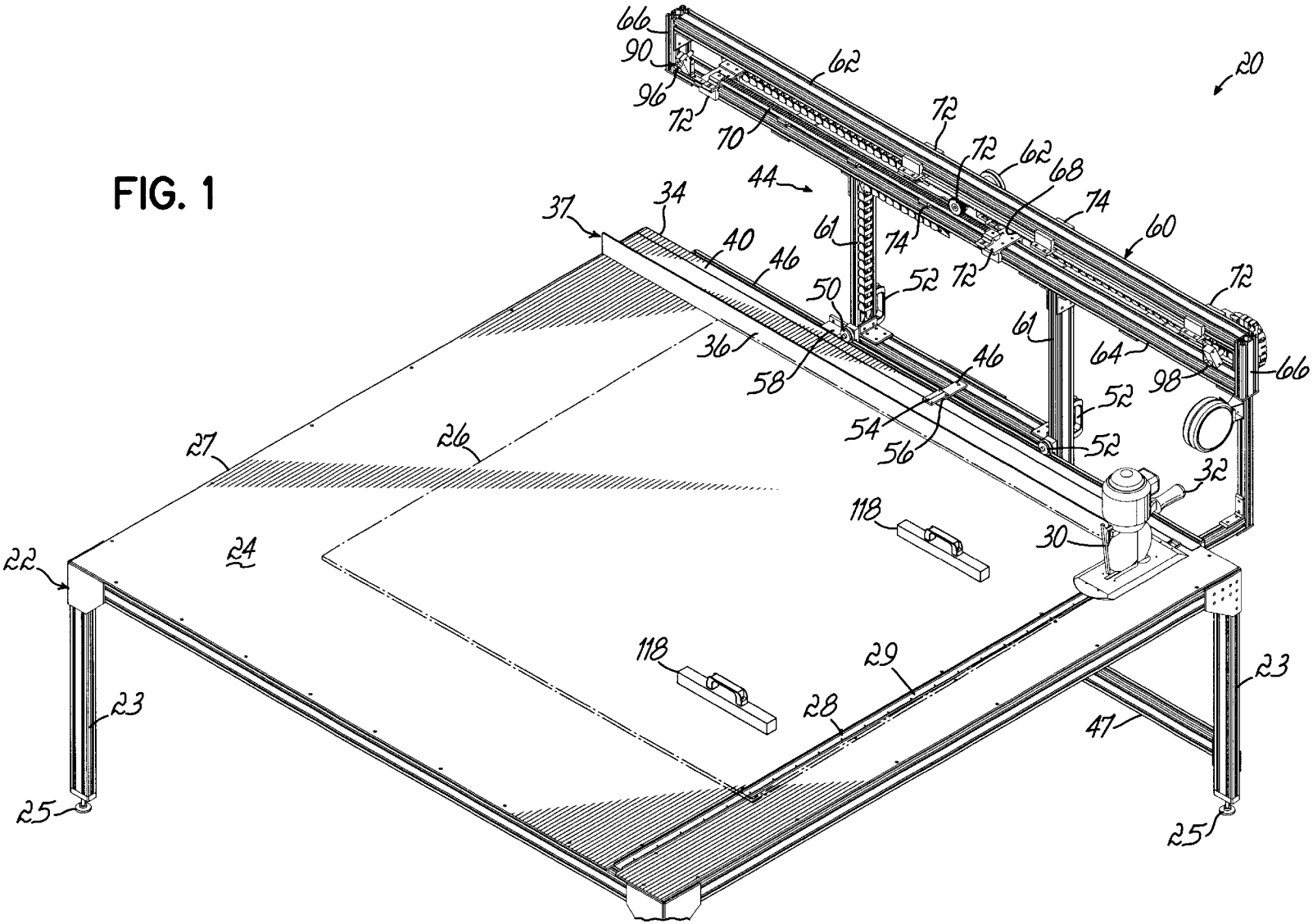
FIG. 1 is a front perspective view of a fabric goods cutting table with alignment lasers in accordance with the principles of the present invention.

Referring to FIG. 1, a fabric goods cutting table 20 has a frame 22 that includes four legs 23 with adjustable feet 25 for leveling the table 20. The frame 22 is assembled from cut pieces of commercially available extruded aluminum. The cutting table 20 has a top 27 made from a suitable material, for example, plastic, metal, etc., and has a flat upper surface 24 for supporting flat goods or material 26, for example, a piece of fabric that may be quilted. A trackway 28 is recessed into the top surface 24 and guides a cutter 30. The cutter 30 is supported on the trackway 28 by linear bearings and thus, the cutter 30 is easily manually moved back and forth along the trackway 28 by an operator gripping the handle 32. The cutter 30 has a powered cutting tool (not shown) the path of which along the trackway 28 defines a cutting path 29 of the cutter 30.

Mounted near a rear side 34 of the cutting table 20 is a guide 36. The guide 36 is formed by one side of right angle bar stock 37. A perpendicular side 38 (FIG. 2) of the right angle bar stock 37 is attached to the table surface 24 by bonding, fasteners or other known means. A scale 40 is also attached to the table top 24 behind the guide 36. The scale 40 has a zero value that intersects the cutting path 29 extending along the trackway 28. The scale 40 can be adhered or bonded to the table surface 24; however, attaching the scale 40 with fasteners permits adjustment of the scale 40 with respect to the cutting path 29.

Figure 2:
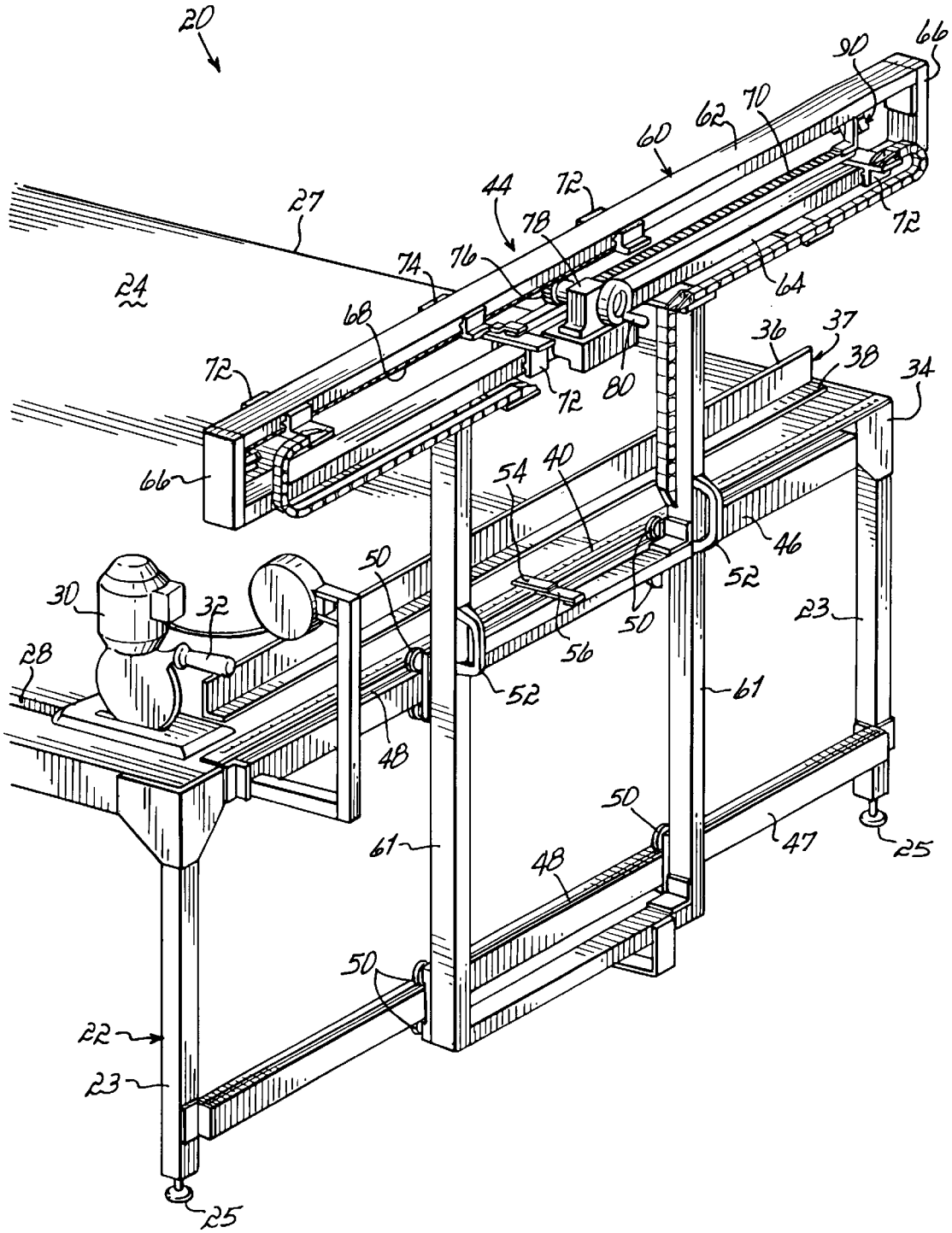
FIG. 2 is a rear perspective view of the fabric goods cutting table of FIG. 1.

Referring to FIG. 2, a movable carriage 44 is mounted on the rear side 34 of the cutting table 20. The movable carriage 44 is mounted on upper and lower crossrails 46,47, respectively, extending across the rear side 34 of the table frame 22. The crossrails 46, 47 have respective grooves 48 that receive and guide the circumferential edges of rollers 50. Handles 52 permit the carriage 44 to be moved linearly along the crossrails 46, 47 over the width of the cutting table 20. A particular location may be chosen by aligning an indicator line or pointer 54 on a finger 56 with a dimension marked on the scale 40. A locking plate 58 (FIG. 1) is mounted to the carriage 44 immediately adjacent the upper crossrail 46. The carriage 44 is locked at a desired location with respect to the crossrails 46, 47 by tightening a screw (not shown) that extends through the locking plate 58 and against the upper crossrail 46.

Figure 3:
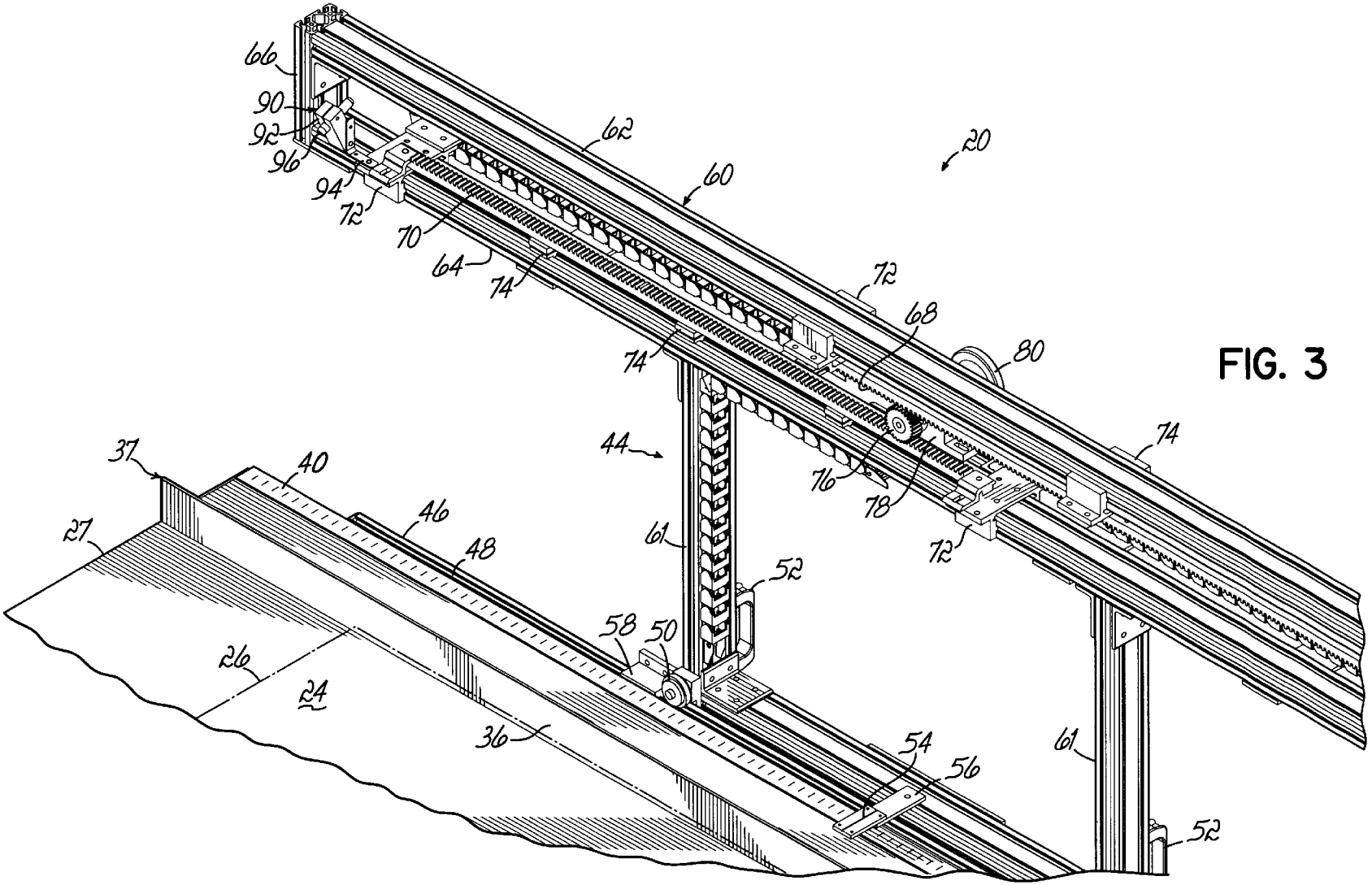
FIG. 3 is a partial perspective view of a laser mounting and motion assembly of the fabric goods cutting table of FIG. 1.

The carriage 44 is made from the same aluminum extrusions as the frame 22 and is generally T-shaped with a horizontal, rectangular top frame 60 that is rigidly connected to upper ends of a pair of generally vertical posts 61. The top frame 60 has a pair of parallel upper and lower cross members 62, 64, respectively, that are tied together at their ends by a pair of opposed straps 66. The top frame 60 has a length that is substantially coextensive with the rear side 34 of the cutting table 20. Referring to FIG. 3, upper and lower racks 68, 70 are mounted for sliding motion with respect to the upper and lower cross members 62, 64, respectively. End slider blocks 72 and intermediate slider blocks 74 are connected to the racks 68, 70 and guide linear motion of the racks 68, 70 relative to the respective cross members 62, 64. A pinion 76 is rotatably mounted in a gear box 78 (FIG. 1) that, in turn, is mounted to the lower cross member 64. The pinion 76 is mechanically coupled within the gear box 78 to a manually operable hand wheel 80. Thus, rotation of the hand wheel 80 directly rotates the pinion 76 which results in equal but opposite linear motions of the upper and lower racks 68, 70 with respect to the respective upper and lower cross members 62, 64.

Referring to FIG. 3, a first laser mounting assembly 90 is connected to an outer end. of the lower rack 70. A laser mounting bracket 92 and laser alignment bracket 94 are connected to the end slider block 72. A laser 96 is mounted on the bracket 92 at an orientation such that it illuminates the table surface 24 with a line of light that is substantially perpendicular to the guide 36 and substantially parallel to the cutting path 29 of the cutter 30. Such a laser 96 is commercially available as part no. 17405, Style #L7LL, from LaserLyte of Torrance, Calif. As shown in FIG. 1, a laser 98 is mounted on an end of the upper rack 68. The laser 98 and its mounting is substantially identical to the laser 96.

Figure 4A:
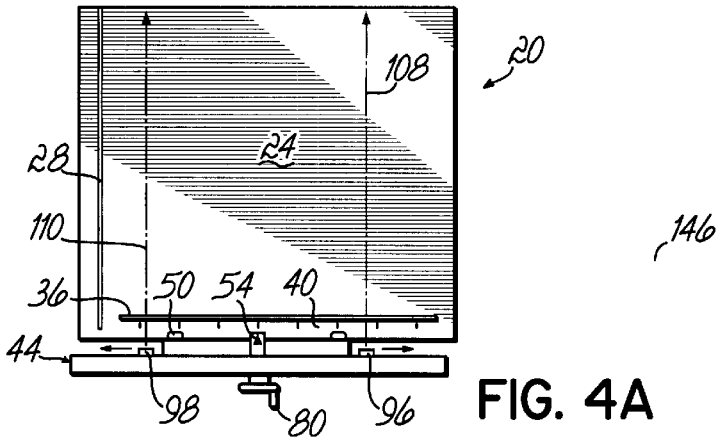
FIGS. 4A–4E are schematic top plan views illustrating one example of the operation of the fabric goods cutting table of FIG. 1.

In use, referring to FIG. 4A, the handles 52 are used to linearly move the carriage 44 such that the indicator 54 aligns with a value on the scale 40 that is equal to the desired width of the fabric 26, for example, 80 inches.

Since the indicator 54 is a center line indicator, the scale 40 is dimensioned in half-scale markings, that is, the 80 inch marking is 40 inches from the zero reference. The locking plate 58 is then secured to the upper crossrail 46, thereby locking the carriage 44 at a position at which light beams 108, 110 of respective lasers 96, 98 are equidistant from the desired center line of the fabric.

Figure 4B:
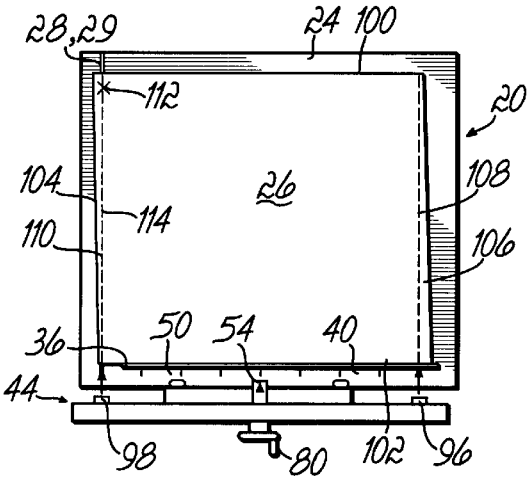

Referring to FIG. 4B, the fabric 26 is placed on the top surface 24 of the cutting table 20. The fabric 26 is normally rough cut to length such that it has substantially linear and parallel front and rear edges 100, 102, respectively. However, the fabric 26 has not been cut to width and to optimize the use of the fabric as well as the efficiency of subsequent sewing operations, it is desired that the selvage on the opposed first and second sides 104, 106, respectively, be cut off to provide side edges that are parallel and separated by a desired width.

To properly align the fabric on the surface 24, the rear edge 102 is first aligned with the guide 36, and the selvage edge 104 is located to the left of the cutting path 29 as viewed in FIG. 4B. The lasers 96, 98 are turned on, and they illuminate the upper surface of the fabric 26 with respective lines of light 108, 110. Next, the handwheel 80 is manually rotated, thereby causing the lasers 96, 98 to move. The handwheel 80 is used to align the light beam 110 of the laser 98 with the zero scale value and the cutting path 29 of the cutter 30. The fabric 26 is checked again to make sure that the selvage edge 104 is to the left of the light beam 108.

While the laser 98 on the upper rack 68 was being moved to the left as viewed in FIG. 4B to the zero reference on the scale 40 by rotation of the handwheel 80, the rack and pinion construction caused the lower rack 70 and laser 96 to be moved an equal distance to the right. Thus, when the light beam 110 is aligned with the cutting path 29, the laser 96 is automatically positioned at a location such that the light beam 108 is separated from the light beam 110 by the desired width of the fabric 26, that is, in the present example, the light beam 108 is 80 inches away from the light beam 110.

Figure 4C:
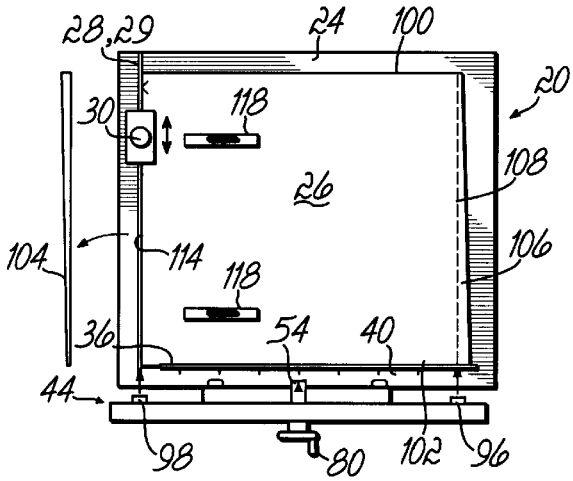
Figure 4D:
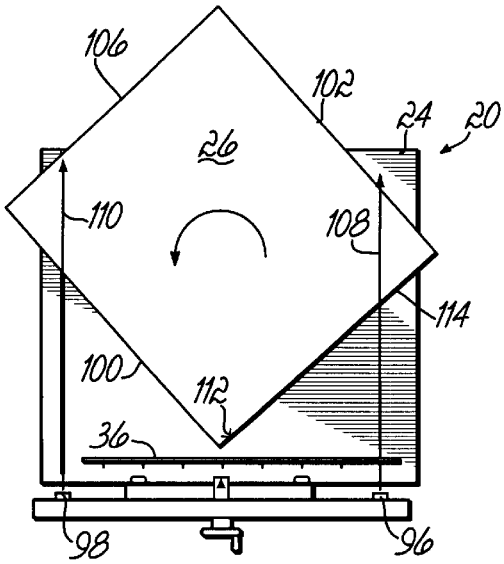
Figure 4E:
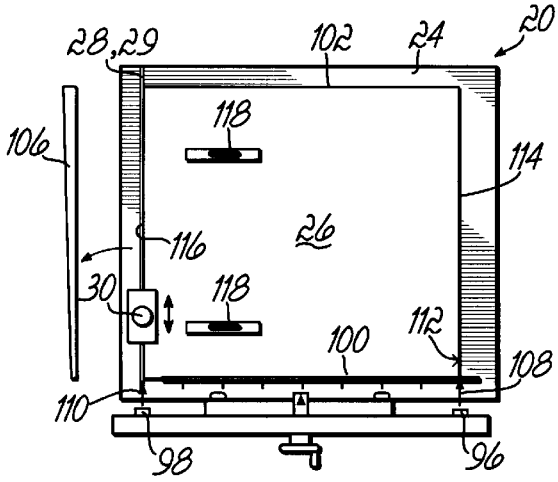

At this point, a marking or indicia 112 is made on the fabric 26 near its front side 100 and in alignment with the laser light beam 110. Thereafter, referring to FIG. 4C, weights 118 are placed over the fabric 26 to hold it in place. The cutter 30 is moved with its handle 32 along the trackway 28, thereby cutting off the selvage edge 104 and providing a straight cut edge 114 that is substantially perpendicular to the fabric rear edge 102. Thereafter, as shown in FIG. 4D, the weights 118 are removed; and the fabric 26 is rotated 180° until, as shown in FIG. 4E, the indicia 112 and cut edge 114 are aligned with the light beam 108 from the laser 96. The weights 118 are again placed over the fabric 26, and cutter 30 is again manually moved along the trackway 28 to cut off the selvage edge 106. That operation provides another straight cut edge 116 that is separated from the first cut edge 114 by the desired width, that is, in this example, 80 inches. Further, the second cut edge 116 is parallel to the first cut edge 114 and perpendicular to the fabric ends 100, 102.

Figure 5A:
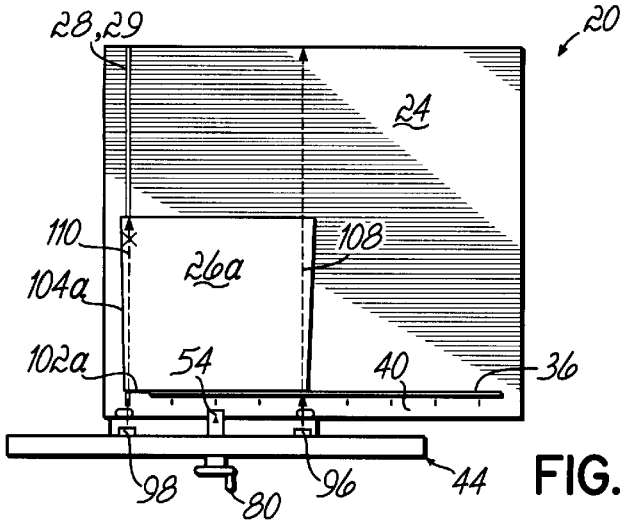
FIGS. 5A–5D are schematic top plan views illustrating another example of the operation of the fabric goods cutting table of FIG. 1.
Figure 5B:
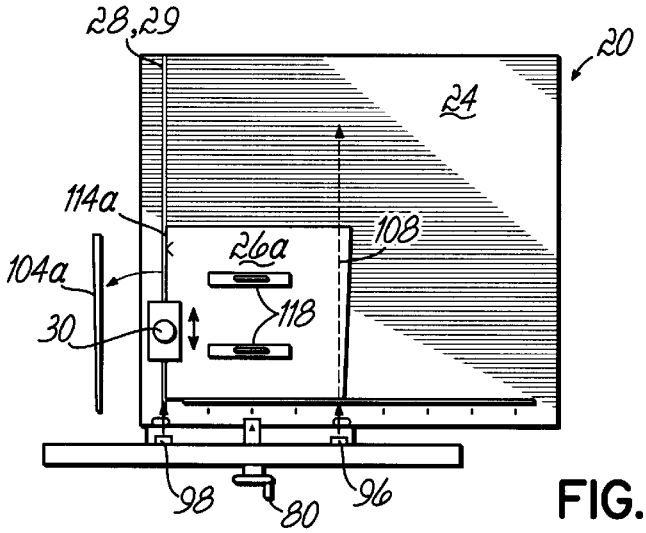
Figure 5C:
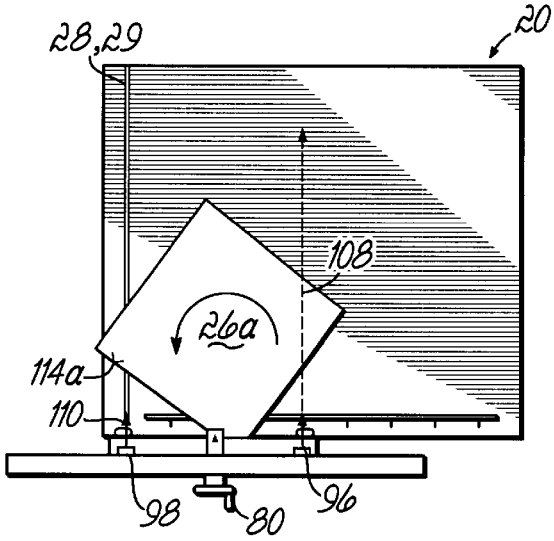
Figure 5D:
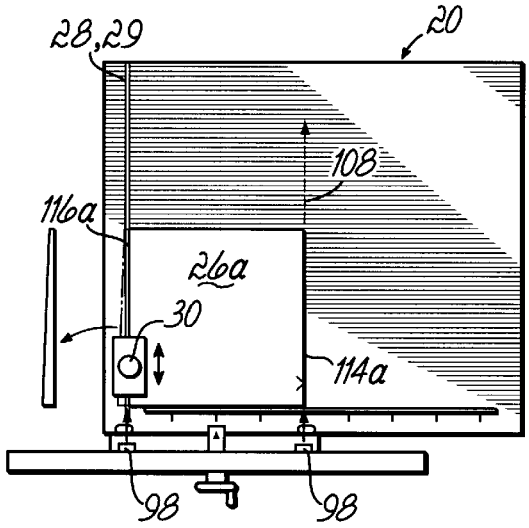

Referring to FIG. 5A, the process is again illustrated using a different size fabric 26*a*. Again, the carriage 44 is moved to a location where the indicator 54 aligns with a dimensional value of the scale 40 that is equal to the desired width of the fabric 26*a*. The carriage 44 is locked in position; and the handle 80 is rotated to move the lasers 96, 98 in a direction such that the light beam 110 aligns with the zero reference of the scale 40 and the cutting path 29 of the cutter 30. The fabric 26*a* is spread over the surface 24, so that the rear edge 102*a* is aligned with the guide 36 and the selvage edge 104*a* is located to the left of light beam 110 as viewed in FIG. 5A. Referring to FIG. 5B, the weights are placed on the fabric 26*a*; the cutter 30 is moved along the trackway 28 to cut off a selvage edge 104*a* and produce a first cut edge 114*a*. The weights 118 are then removed; and as shown in FIG. 4C, the fabric 26*a* is rotated 180° to move the cut edge 114*a* into alignment with the light beam 108 from the laser 96. The cutter 30 is again moved along the trackway 28 to cut off the selvage edge 106*a* and produce a second cut edge 116*a* that is parallel to, and separated a desired distance or width from, the first cut edge 114*a*.

Figure 6A:
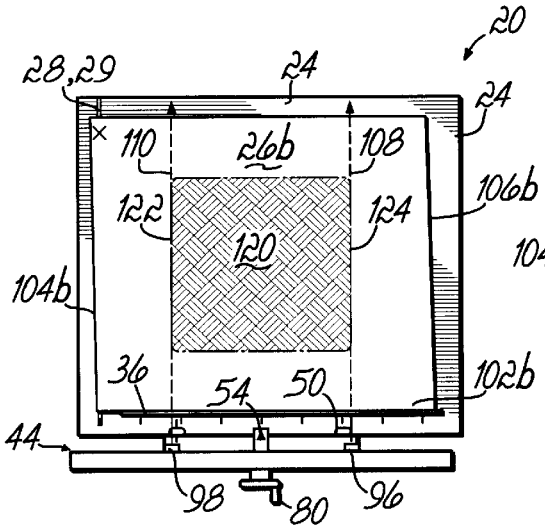
FIGS. 6A–6D are schematic top plan views illustrating a further example of the operation of the fabric goods cutting table of FIG. 1.

Referring to FIG. 6A, the cutting table 20 can be used with a piece of fabric 26*b* having a pattern 120, for example, a quilted pattern, image, etc., at its center. For the pattern to accurately have its desired centered orientation, the selvage edges 104*b*, 106*b* should be cut to be the same distance from the respective pattern sides 122, 124. The cutting table may be used in different ways depending on whether the distance from the pattern edges 122, 124 to the respective fabric edges 104, 106 should be simply equal or a specified dimension. If they are simply to be equal, then the following process can be used. First, the fabric 26*b* is spread on the surface 24 with its rear edge 102*b* located against the guide 36 and its selvage edge 104*b* extending to the left of the cutting path 29 as viewed in FIG. 6A.

If the pattern width, that is, the distance between the pattern edges, is known, as described above, the carriage 44 is moved to a location at which the indicator 54 is aligned with a dimension on the scale 40 equaling the pattern width. At this point, the light beams 108, 110 should align over the respective pattern edges 124, 122. As will be appreciated, the pattern width may not be exactly the size specified; and one or both of the light beams may not align with the pattern edges 122, 124. In this event, the handwheel 50 and carriage 44 should be adjusted until the lasers beams 108, 110 do align with the respective pattern edges 124,122; and the carriage 44 is then locked at that location. The above procedure of manipulating both the handwheel 80 and the location of the carriage 44 can also be used if the width of the pattern 120 is not known.

Figure 6B:
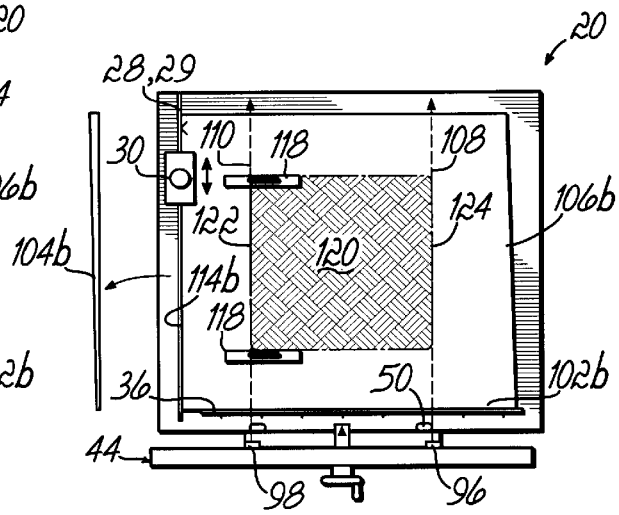
Figure 6C:
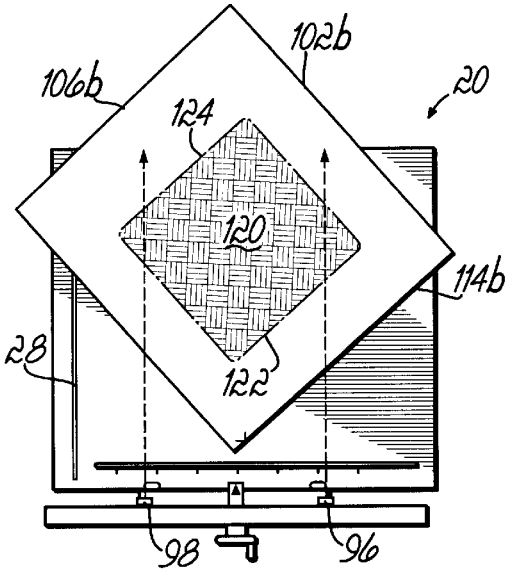

Referring to FIG. 6B, the weights 118 are placed over the fabric 26*b*; and the cutter 30 is moved along the trackway 28 to cut off the selvage edge 104*b* and provide a first cut edge 114*b*. Referring to FIG. 6C, the weights 118 are removed and the fabric 26*b* is rotated 180° to move the cut edge 114*b* into alignment with the light beam 108. The weights 118 are again placed over the fabric 26*b*; and the cutter 30 is again moved along the trackway 28 to cut off the selvage edge 106*b*. That operation produces a second cut edge 116*b* that is parallel to the first cut edge 114*b*; and further, the cut edges 114*b*, 116*b* are a uniform distance from the respective pattern edges 122, 124.

Figure 6D:
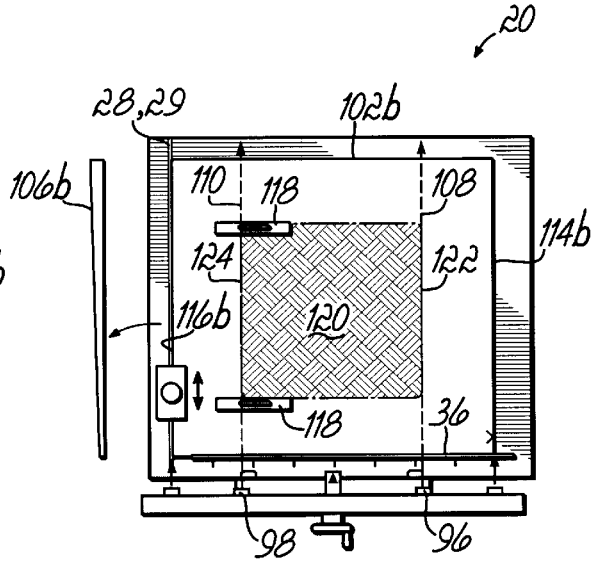

In other applications, it may be desirable that the cut edges 114*b*, 116*b* be a specified distance from the respective pattern edges 122, 124. Referring to FIG. 6A, after the fabric 26*b* is spread on the surface 24 so that the rear edge 102*b* aligns with the guide 36, the handwheel 80 is turned until the light beams 108, 110 align with the respective pattern edges 124, 122. Then the carriage 44 is unlocked and moved until the light beam 110 is aligned with a dimension on the scale 40 that is equal to the specified distance between the cut edges and the respective pattern edges. The carriage 44 is again locked. The fabric 26*b* is then relocated on the surface 24 until the pattern edges 122,124 align with the respective light beams 110, 108 and the rear edge 102*b* is located against the guide 36. The above described process with respect to FIGS. 6B–6D is then repeated with the result that the cut edges 114*b*, 116*b* are the specified distance from the respective pattern edges 122, 124.

In the above description, the fabric 26*b* has a pattern 120 with opposed edges 122, 124 that are used to align the laser lights 108, 110. As will be appreciated, the edges 122, 124 function as alignment guides or elements; and alternatively, the pattern 120 may have other indicia functioning as alignment guides. The fabric cutting process is simplified and most efficient if the alignment guides are symmetrical with respect to the pattern center line or the cut fabric center line, if different. In such applications, the pattern 120 does not have to have parallel edges but could be circular or irregular in shape.

The cutting table 20 thus permits fabric to be easily and quickly manually aligned and accurately cut with parallel edges. The cutting table 20 as an advantage of being able to service those markets where fully automated machines are price prohibitive. The,cutting table 20 also permits fabric having a center pattern to be quickly manually aligned and cut to provide a uniform border with respect to the centered pattern. Further, the size of the border can be specified. Hence the cutting table 20 has a further advantage of having more flexibility. By being manually aligned and operated, the cutting table 20 permits fabric with minimal selvage to be trimmed and used in production. Such fabric may otherwise be scrapped, and therefore, the cutting table 20 is capable of more efficiently using the fabric.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, in the described embodiment, the scale 40 is dimensioned with half-scale markings. As will be appreciated, in an alternative embodiment, the scale 40 can be dimensioned with full-scale markings; and the indicator 54 would be aligned with a scale marking representing one-half the desired width.

Further, in the described embodiment, the indicator 54 is mounted midway between the lines of light 108, 110 and is used to align to a center line of the fabric or pattern with the scale 40. As will be appreciated, in another embodiment, the indicator 54 could be mounted in alignment with the light 110 from laser 98. With such an embodiment, the scale 40 can be dimensioned with full-scale markings.

In the described embodiment. lasers 96, 98 project respective light beams that illuminate lines of light 108, 110 on the fabric 26. As will be appreciated, in other embodiments, other lasers may be used, for example, lasers that project a spot or a short line of light may also be used. In such an embodiment, a laser 98 can be used to project a spot of light at any point along the cutting path 29. Such spot is used to identify when the indicia 112 is marked on the fabric 26. Similarly, a spot of light from the laser 96 can be used to locate the indicia 112 after the fabric 26 has been rotated 180° and realigned against the guide 36.

In the described embodiment, the cutting table is used to cut the fabric to a desired first dimension or width. As will be appreciated, the fabric can be rotated 90°, and the cutting table used to cut the fabric to a desired dimension in another direction, for example, to a desired length. Further, in the described embodiment, lasers 96, 98 are used to provide the light beams 108, 110. As will be appreciated, in alternative embodiments, the light beams may be provided by other light emitting devices, for example, IR devices, LED's, etc.

Therefore, the invention in its broadest aspects is not limited to the specific details shown and described. Consequently, departures may be made from the details described herein without departing from the spirit and scope of the claims which follow.

What is claimed is:

1. A cutting table for cutting pieces of fabric comprising:

a frame;

a table surface mounted on the frame and adapted to support the fabric;

a first edge guide adapted to receive an edge of the fabric;

a cutter manually movable along a linear cutting path substantially perpendicular to the first edge guide and adapted to cut first and second opposed edges of apiece of fabric;

first and second light emitting devices emitting respective first and second light beams, the second light beam being spaced further from the cutter than the first light beam in a direction substantially perpendicular to the linear cutting path, the first and second light beams emitting light in a direction substantially parallel to the linear cutting path, the second light beam providing a second edge guide substantially perpendicular to the first edge guide and adapted to align the first edge of the piece of fabric after being cut by the cutter; and a manually powered drive supporting the first and second light emitting devices in a spaced apart relationship, the drive being manually operable to simultaneously move the first and second light emitting devices through equal displacements in opposite directions substantially perpendicular to the linear cutting path.

2. The cutting table of claim 1 wherein the manually powered drive further comprises:

a pinion;

first and second racks supporting the respective first and second light emitting devices, the first rack engaging one side of the pinion and the second rack engaging an opposite side of the pinion, such that rotation of the pinion moves the racks through equal displacements in opposite directions; and a handwheel connected to the pinion.

3. The cutting table of claim 1 further comprising a carriage supporting the manually powered drive and mounted on the frame to be manually movable in a direction substantially perpendicular to the cutting path.

4. The cutting table of claim 3 further comprising.

a scale mounted on the frame.

5. The cutting table of claim 3 further comprising an indicator mounted on the carriage at a location substantially midway between the first and second lights beams.

6. The cutting table of claim 4 wherein the scale is dimensioned in half-scale units.

7. The cutting table of claim 6 wherein the scale has a zero reference in substantial alignment with the linear cutting path.

8. The cutting table of claim 1 further comprising a track supported by the frame and guiding the cutter along the cutting path.

9. The cutting table of claim 8 wherein the cutter is motorized.

10. A cutting table for cutting pieces of fabric comprising:

a frame;

a table surface mounted on the frame and adapted to support the fabric;

an edge guide adapted to receive an edge of the fabric;

a cutter manually movable along a linear cutting path substantially perpendicular to the edge guide;

a carriage mounted on the frame to be manually movable in a direction substantially perpendicular to the cutting path;

first and second light emitting devices emitting respective first and second lights in a direction substantially parallel to the linear cutting path;

a manually powered drive mounted on the carriage and supporting the first and second light emitting devices in a spaced apart relationship, the drive being manually operable to move the first and second light emitting devices through equal displacements in opposite directions substantially perpendicular to the linear cutting path;

a scale mounted on the frame; and an indicator mounted on the carriage at a location substantially midway between the first and second lights.

11. A method of cutting a piece of fabric having four edges comprising:

manually placing the fabric on a table surface to locate a first edge against an edge guide, and a second, adjacent edge across a linear cutting path substantially perpendicular to the edge guide;

manually moving first and second lightemitting devices to positions where the first and second light emitting devices project respective first and second lights onto the fabric at locations providing a desired dimension of the fabric;

manually moving a cutter along the linear cutting path identified by the first light to cut a second edge of the fabric substantially perpendicular to the manually moving the fabric on the table surface to locate a third edge, opposite the first edge, against the edge guide, and to substantially align the second edge of the fabric with the second light; and manually moving a cutter along the linear cutting path to cut a fourth edge of the fabric substantially parallel to the second edge, the distance between the second and fourth edges being substantially equal to the desired dimension of the fabric.

12. The method of claim 11 further comprising:

manually moving the pair of light emitting devices to position the first and second lights equidistant from a desired center line of the fabric; and manually moving the pair of light emitting devices to locate projections of the first and second lights on the fabric at the desired dimension.

13. The method of claim 12 further comprising:

manually moving a carriage supporting the pair of light emitting devices to a carriage position where the first and second lights are equidistant from a desired center line of the fabric;

manually locking the carriage at the carriage position; and manually moving the pair of light emitting devices with respect to the carriage to locate the projections of the first and second lights on the fabric at the desired dimension.

14. The method of claim 13 further comprising manually moving the pair of light emitting devices simultaneously through equal increments an in opposite directions to locate the projections of the first and second lights on the fabric at the desired dimension.

15. A method of cutting a piece of fabric having four edges comprising:

manually placing the fabric on a table surface to locate
a first edge against an edge guide, and
a second, adjacent edge across a linear cutting path substantially perpendicular to the edge guide;

manually moving first and second light emitting devices to positions where first and second lights from respective first and second light emitting devices are substantially equidistant from a desired center line of the fabric;

manually moving a cutter along the linear cutting path identified by the first light to cut a second edge of the fabric substantially perpendicular to the first edge;

manually moving the fabric on the table surface
to locate a third edge, opposite the first edge, against the edge guide, and
to substantially align the second edge of the fabric with the second light; and manually moving a cutter along the linear cutting path to cut a fourth edge of the fabric substantially parallel to the second edge, the distance between the second and fourth edges being substantially equal to a desired dimension of the fabric.

16. A method of cutting a piece of fabric having four edges and a pattern located between the edges, the pattern having firstand second alignment guides, the method comprising:

manually placing the fabric on a table surface to locate
a first edge against an edge guide, and
a second, adjacent edge across a linear cutting path substantially perpendicular to the edge guide;

manually moving first and second light emitting devices to positions where the first and second light emitting devices project respective first and second lights onto the fabric in substantial alignment with the first and second alignment guides, respectively;

manually moving a cutter along the linear cutting path identified by the first light to cut a second edge of the fabric substantially perpendicular to the first edge;

manually moving the fabric on the table surface
to locate a third edge, opposite the first edge, against the edge guide, and
to substantially align the second and first alignment elements with the first and second lights, respectively; and manually moving a cutter along the linear cutting path to cut a fourth edge of the fabric substantially parallel to the second edge, the pattern being substantially centered between the second and fourth edges.

17. A method of cutting a piece of fabric having four edges and a pattern located between the edges, the pattern having first and second alignment guides, the method comprising:

manually placing the fabric on a table surface to locate
a first edge against an edge guide, and
a second, adjacent edge across a linear cutting path substantially perpendicular to the edge guide;

manually moving first and second light emitting devices to positions where first and second lights from respective first and second light emitting devices are substantially equidistant from a center line of the pattern;

manually moving a cutter along the linear cutting path identified by the first light to cut a second edge of the fabric substantially perpendicular to the first edge;

manually moving the fabric on the table surface
to locate a third edge, opposite the first edge, against the edge guide, and
to substantially align the second and first alignment elements with the first and second lights, respectively; and manually moving a cutter along the linear cutting path to cut a fourth edge of the fabric substantially parallel to the second edge, the first and second alignment guides of the pattern being located substantially equidistant from respective second and fourth edges of the fabric.

18. A method of cutting a piece of fabric having four edges and a pattern located between the edges, the pattern having first and second alignment guides, the method comprising:

manually placing the fabric on a table surface to locate
a first edge against an edge guide, and
a second, adjacent edge across a linear cutting path;

manually moving first and second light emitting devices to positions where first and second lights from respective first and second light emitting devices are substantially aligned with the respective first and second alignment guides and thus, have a desired separation;

manually moving first and second light emitting devices together without changing the desired separation to a Location where the first light is a desired distance from the cutting path;

manually moving the fabric on a table surface to locate
the first edge against the edge guide,
the second, adjacent edge across the linear cutting path, and
the first and second lights in substantial alignment with the respective first and second alignment guides;

manually moving a cutter along the linear cutting path identified by the first light to cut a second edge of the fabric substantially perpendicular to the first edge;

manually moving the fabric on the table surface
to locate a third edge, opposite the first edge, against the edge guide, and
to substantially align the second and first alignment elements with the first and second lights, respectively; and manually moving a cutter along the linear cutting path to cut a fourth edge of the fabric substantially parallel to the second edge, the distance between the second and fourth edges having a desired spacing with respect to the respective first and second alignment guides of the pattern.

* * * * *

UNITED STATES PATENT AND TRADEMARK OFFICE

CERTIFICATE OF CORRECTION

PATENT NO. : 6,644,156 B2 
DATED : November 11, 2003
INVENTOR(S) : Richard S. Villacis It is certified that error appears in the above-identified patent and that said Letters Patent is hereby corrected as shown below:

Column 2,
Line 27, reads “advantages of the present in will” and should read
-- advantages of the present invention will --.

Column 3,
Line 50, reads “outer end. of the” and should read -- outer end of the --.
Line 65, the USPTO typed new paragraph and there should not be a new paragraph.
Line 66, reads "center 1ine" and should read -- centerline --.

Column 4,
Line 5, reads "center line" and should read -- centerline --.

Column 6,
Line 16, reads “as” and should read -- has --.
Line 19, reads “The, cutting table” and should read -- The cutting table --.
Line 48, reads “embodiment. lasers” and should read -- embodiment, lasers --.

Column 7,
Line 15, reads "edges of apiece of” and should read -- edges of a piece of --.
Line 47, reads "further comprising." and should read -- further comprising: --.
Line 51, reads "first and second lights beams" and should read -- first and second light beams -- .

Column 8,
Line 26, reads "lightemitting" and should read -- light emitting -- .
Line 34, reads "perpendicular to the [missing words]" and should read -- perpendicular to the first edge; --.
Line 48, reads "center line" and should read -- centerline --.
Lines 55-56, reads “a desired center line of the fabric;” should read -- a desired centerline of the fabric; --.
Line 65, reads “an” and should read -- and --.

Column 9,
Line 10, reads “center line” and should read -- centerline --.
Line 28, reads “firstand” and should read -- first and --.

UNITED STATES PATENT AND TRADEMARK OFFICE

CERTIFICATE OF CORRECTION

PATENT NO. : 6,644,156 B2
DATED : November 11, 2003
INVENTOR(S) : Richard S. Villacis It is certified that error appears in the above-identified patent and that said Letters Patent is hereby corrected as shown below:

Column 10,
Line 4, reads “center line” and should read -- centerline --.
Line 35, reads “to a Location” and should read -- to a location --.

Signed and Sealed this

Twenty-third Day of March, 2004

JON W. DUDAS
*Acting Director of the United States Patent and Trademark Office*